United States Patent [19]

Oana

[11] 4,219,126

[45] Aug. 26, 1980

[54] SAFE CARTRIDGE FOR GAS

[76] Inventor: Katsuo Oana, 17-6, 4 chome, Sugano, Ichikawa-shi, Chiba-ken, Japan

[21] Appl. No.: 25,061

[22] Filed: Mar. 29, 1979

[51] Int. Cl.[3] ..... B65D 25/00

[52] U.S. Cl. ..... 220/89 A; 220/266; 220/367

[58] Field of Search ..... 220/89 A, 266, 367; 137/68 R

[56] References Cited

U.S. PATENT DOCUMENTS 3,815,534 6/1974 Kneusel ..... 220/89 A X

*Primary Examiner*—George T. Hall

*Attorney, Agent, or Firm*—Haseltine, Lake & Waters

[57] ABSTRACT

This invention relates to a safe cartridge for gas and intends that, when the cartridge has been overheated and the inner pressure has abnormally risen, let an invisible crack open in a suitable area of the cartridge to escape the inner gas gradually to reduce the inner pressure, without gushing out a large quantity of the gas in a moment, as in usual rupture discs, to prevent the flying of the cartridge by the force of reaction.

3 Claims, 13 Drawing Figures

SAFE CARTRIDGE FOR GAS

BRIEF SUMMARY OF THE INVENTION

In the invention, by providing a limited recess or recesses in a thinner portion than the body of a cartridge, for example, a thin portion formed in a certain portion of the body or of a sealing plate which is fixed in respect of an opening portion of the body by welding, calking or otherwise using a cap nut and seals the opening, when the inner pressure has abnormally risen, let stresses concentrate in the thinned portion to outwardly inflate the portion. Through this inflation of the portion, a tension and a shear act on the bottom of the recess and at last an invisible crack appears through the bottom, through which the inner gas is made to leak out gradually.

BRIEF EXPLANATION OF THE DRAWINGS

The drawings illustrate embodiments of the invention, in which.

DETAILED DESCRIPTION

Figure 1:
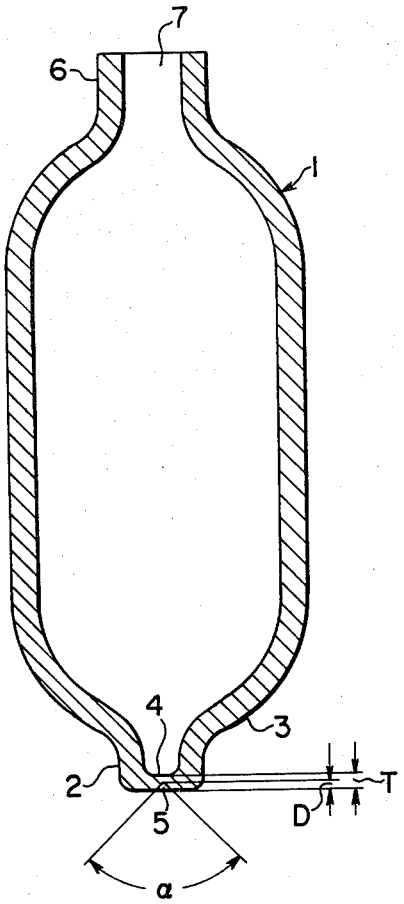
FIG. 1 is a view of a cartridge longitudinally sectioned and omitted a sealing plate portion.

The present invention relates to a safe cartridge for gas and an object of the invention is to prevent the exploding of a cartridge or the flying of the cartridge by the reaction force upon the gushing gas, by making an invisible crack open, and by gradually letting the inner gas through the crack when the cartridge has been overheated and the inner pressure has abnormally risen.

At the present time, small cartridges are used in such articles as fire-extinguishers, tappers of draught beer, syphons, etc., as a pressure energy to push the powder or the liquid out of them. As these articles have become much used in general homes, it becomes necessary to prevent the second disaster, in consideration of a danger of an explosion of a cartridge from carelessness of handling and mischief by children. The cartridge is usually small, however, the pressure of the gas charged therein is higher than 70 kg/cm$^2$. The inner pressure rises when the gas is expanded by heat. For example, in the case of the $CO_2$ gas of the charging ratio of 1.5, though both the temperature and the pressure have been designated in general numbers, the pressure is at 120 kg/cm$^2$ when the temperature is at 40° C., 200 kg/cm$^2$ when 70° C., 300 kg/cm$^2$ when 100° C. and 400 kg/cm$^2$ when 130° C., respectively. When the inner pressure rises as above mentioned, it becomes very dangerous as the cartridge explodes or flies by the propellent force which reacts upon an emitting gas.

Up to date, to prevent an explosion of a pressure container or a pressure pipeline by an abnormal rising of the inner pressure, a safe device which is provided with the rupture disc and gushes the inner pressure in a moment by rupturing a rupture disc in a wide area when the pressure has abnormally risen, has been well known. If the device is applied to the cartridge of this invention, it will be probably sure that an explosion of the cartridge can be prevented. But the cartridge will fly as a bomb by the reaction force upon the gushing gas and this should be very dangerous. Then such the rupture disc can never by employed.

In the invention, for opening the invisible crack, a suitable portion of the cartridge is thinly formed more than the other portion, and in a suitable portion of the thinly formed area is or are provided a limited recess or recesses. By which, at the time when the inner pressure has abnormally risen, the thin portion first inflates outwardly and from this inflation a tension and a shear act on the bottom of the recess or recesses, and at last the invisible crack opens through the bottom portion. Then the inner gas escapes gradually through the crack and the inner pressure is reduced. As the escapement of the gas is gradually done, the cartridge does not fly by the reaction.

The thin portion where the limited recess is to be provided may be formed in the body of the cartridge or in the sealing plate which is to be fixed on the body to seal the opening portion of the body.

When the thin portion is formed in the body, there are several methods for forming. One of them is the case where a downwardly protruding portion is formed at the bottom, the bottom wall of the portion being thinned, the limited recess being provided therein. This results such effects as follows: (1) As the diameter of the protruding portion is small, the thickness T of the bottom wall can be evenly made. (2) By designing the diameter of the bottom wall to be small to a certain extent, an uneveness of numerical values of the pressure to open the crack becomes even. (3) The forming of the bottom wall with a certain thickness becomes an easy working by pressing.

If the limited recess is formed in the thin portion formed in the bottom portion itself, without forming such the protruding portion, the working for forming the protruding portion can be omitted. In the case where there is a problem on the anti-inner pressure caused by the enlarging of the thin portion of the bottom portion, the problem can be resolved by spherically forming the bottom portion, by evenly forming the thin portion therein and by forming the recess in the thin portion. In these cases, the recess may be provided in the outer or the inner face of the thin portion or in both the faces in alignment with each other.

The following is the description where the limited recess is provided in the sealing plate. The effects in this case are such as: (1) Being far smaller than the body, the sealing plate is suitable for mass producing and for forming in even thickness. (2) The examinations in thickness, in depth of the recess and at top angle of the sealing plate are easily done.

In general, the sealing plate is formed thinner than the body, to make ease the cutting by a piercing needle, and there is no need to provide a specially thinned portion as in the body.

In the state where the sealing plate is fixed on the body, it is general that in an abnormal rising of the inner pressure the body explodes and the central portion of the sealing plate portion also inflates outwardly. This is very dangerous. Therefore, by utilizing the deformation of the sealing plate portion, it is intended to open the invisible crack before the explosion of the body.

To accomplish the object, a limited recess is provided in the thin portion. The recess may be provided in the outer or the inner face of the portion. When the sealing plate portion is comparatively thick in relation to the anti-inner pressure, the recesses are provided in both the faces in alignment with each other, bottom to bottom. It is generally preferable that the recess is the shape like a mortar. But it makes an open area broad if the recess is formed in one of the faces to the other, and in the area the thickness of the plate becomes thin. So problems on the anti-inner pressure and the enlargement of the crack arise. The problems can be resolved, by forming the recesses in both the faces in alignment with each other. If one of the recesses is formed like a column, the thickness of the plate becomes extremely enlarged at the nearest portion to the outer circumferences of the recess, the crack can be restrained from enlarging.

It goes without saying on the small cartridge, when the sealing plate is used on a comparatively large cartridge with a valve, it is formed as a layer, that is, to a comparatively thick base plate with an opening is attached a comparatively thin subordinate plate to close the opening. In the subordinate plate is provided the limited recess with respect to the opening. The sectional area of the opening of the base plate may be the size, in a small cartridge, through which a piercing needle can move and, in a small and a large cartridges, into which the subordinate plate can inflate and open cracks. Accordingly, on the subordinate plate itself act only the pressures corresponding to the sectional areas of the opening, so that the subordinate plate, in spite of its being thin, can entirely resist to the ordinary inner pressure. If the subordinate plate is comparatively thick, by providing the recesses in both the faces in alignment with each other, bottom to bottom, as stated above, the problems on the anti-inner pressure and the enlargement of the crack can be resolved.

The areas of the openings of a small cartridge and a relief valve of a large cartridge become narrow, and each sum of the inner pressure which acts on each area becomes small. In each case, there is a fear of not inflating outwardly the sealing plate portion and not opening the crack in spite of being a limited recess, though the inner pressure has risen. To enlarge the area of the sealing plate portion upon which the pressure acts, the top portion with a limited recess is made to fold back at least to the end of the opening of the cartridge after the top portion has been outwardly extended from the outer circumference of the opening portion, and between the upside of the folded back portion and the underside of the top portion is made a space. The inner pressure acts on the extended underside of the top portion, and the inflation of the top portion and also the opening of the crack proceed certainly. The limited recess may be located in either side of the top portion. If the top portion is thick, same as stated above, by providing the limited recesses in both the sides in alignment with each other, bottom to bottom, the problems on the anti-inner pressure and the enlargement of the crack can be resolved.

In all the cases stated above, the sealing plate portions are attached to the bodies, respectively, by welding, calking or fixing by means of cap nuts and seal the gases.

The embodiments of the invention are hereinafter detailed with reference to the drawings.

Figure 2:
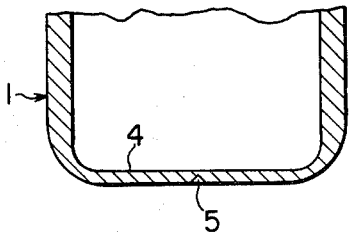
FIG. 2 is a fragmentary sectioned view of the bottom portion of another cartridge.
Figure 3:
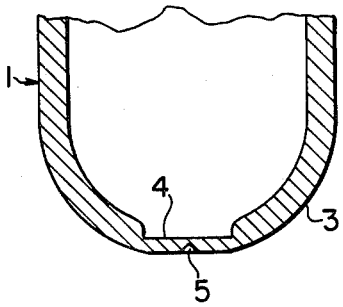
FIG. 3 is a fragmentary sectional view of the bottom portion of further cartridge.

FIG. 1 through FIG. 4 relate to bodies of cartridges. In FIG. 1, 1 is a body, and 2 is a downwardly protruding portion provided at the bottom 3 of the body 1. The bottom wall 4 of the portion 2 is thinly formed, and in the bottom wall is formed a limited recess 5 having the shape of a mortarlike, from the underside to the upside. The depth D and the top angle $\alpha$ to the thickness T of the bottom wall 4 are suitably planned in accordance with a height of the pressure at which the inner gas begins to leak out. 6 is a neck portion, at the outer end of which an opening 7 is provided, and the opening 7 is suitably sealed, after the gas has been charged. FIG. 2 is the case where the bottom portion itself is thinly and flatly formed to be the bottom wall 4, in which the recess 5 is formed. This case is for the lower inner pressure than in FIG. 1. FIG. 3 is the case where a certain portion of the bottom portion 3 is thinly and flatly formed to be the bottom wall 4, and in which the limited recess 5 is formed. This is for the higher inner pressure than in FIG. 2.

Figure 4:
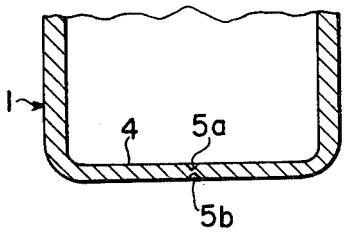
FIG. 4 is a fragmentary sectional view of the bottom portion of further cartridge.

In the examples above stated, the recesses 5 are provided in the outer faces, but they may be provided in the inner faces. FIG. 4 shows the case where the bottom wall 4 is thinly formed, but it is thicker than the former case. The recesses 5*a* and 5*b* are formed in alignment with each other in the inner and the outer faces, respectively, and one of the recesses may be shaped like a column. In this case, the opening of a crack becomes reliable and the enlarging of the crack can be checked.

FIG. 5 through FIG. 11 show the cases where the limited recesses are provided in the sealing plate portions, respectively.

Figure 5:
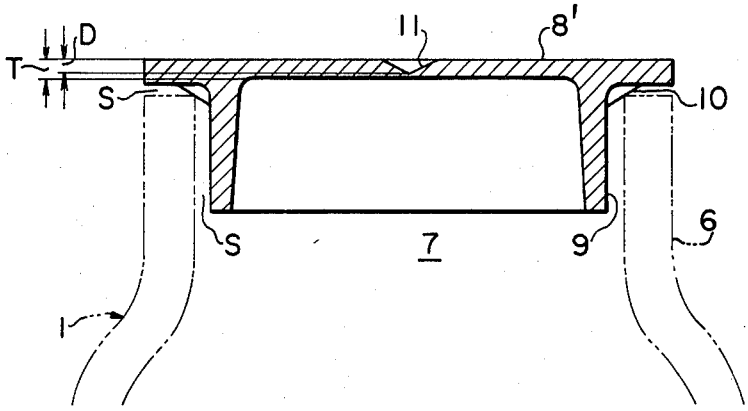
FIG. 5 is a section of a sealing plate portion, in relation to the body, the sealing plate portion being unfixed on the cartridge.

In FIG. 5, the sealing plate portion is shown as a sealing plate 8' which has a circular leg portion 9 to prevent the sealing plate 8' from running off the opening portion 7 and is not yet fixed on the body 1. The sealing plate 8' is, as usual, fixed on the end face of a neck portion 6, for example, by welding, after the leg portion 9 has been inserted into the opening portion 7 of the neck portion 6 and the gas has been charged in the body 1 through a gap S between the plate 8' and the opening portion 7 made by means of projections 10 on suitable outer portions of the leg portion 9. The projections 10 melt away or disappear at this juncture and the gas is kept in the cartridge. The circular leg portion 9 may be formed by pressing or folding, or the portion 9 may be entirely omitted. In the upside of the sealing plate 8', the limited recess 11 is provided. Of course, the recess 11 may be provided in the underside. The crack is to open in the bottom of the recess 11.

Figure 5A:
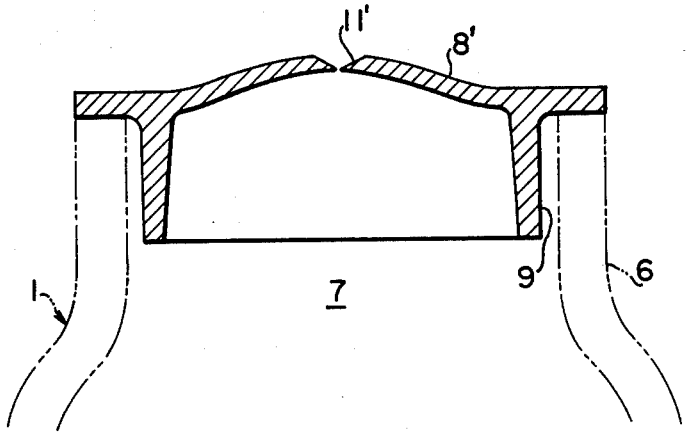
FIG. 5*a* is a sectional view with the dotted portion illustrating the sealing plate at deformation across the width thereof as the recess is being ruptured.

As seen in FIG. 5*a*, when excess pressure exists in the body 1, the plate 8' starts to bow outwardly and continues to deform until the thinned area beneath the recess 11 ruptures and a small opening 11′ is formed to provide an outlet for the gases within the body 1 to escape.

Figure 6:
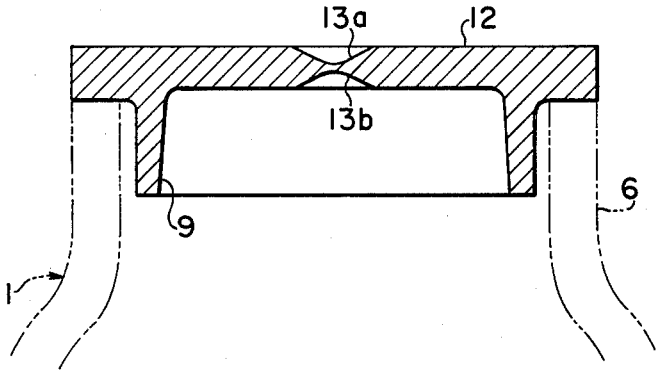
FIG. 6 is a section of another sealing plate portion with recesses in alignment with each other.
Figure 7:
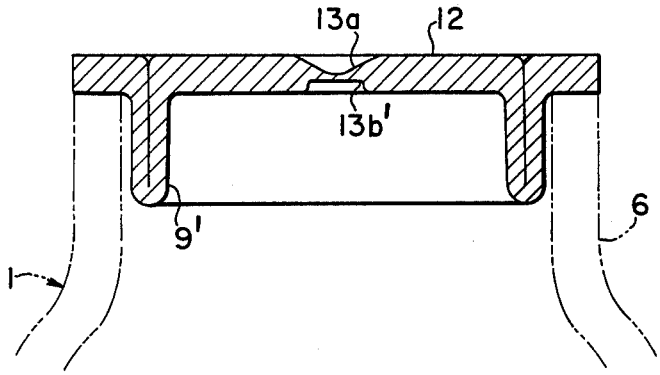
FIG. 7 is a section of further sealing plate portion similar to FIG. 6.

In FIGS. 6 and 7, the sealing plate portion 12 is thick, in both the sides of which the limited recesses 13*a* and 13*b* are provided in alignment with each other, bottom to bottom. One of the recesses 13*a* and 13*b* may be formed a columnlike recess 13*b*′, as shown in FIG. 7. 9′ is a circular leg portion formed by pressing out for preventing a sealing plate from running off the opening portion 7 when the plate is attached to the body 1 and becomes the sealing plate portion 12. In these cases, the cracks are to open in the bottoms of the recesses 13*a* and the enlargements of the cracks will be checked. These recesses 13*a* and 13*b*′ may be oppositely located.

Figure 8:
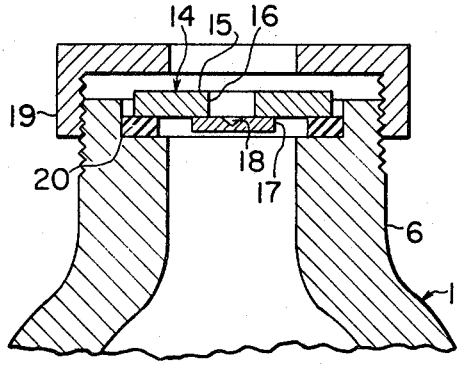
FIG. 8 is a sectional view of a layer type sealing plate portion, in relation to the body, the portion being unfixed on the opening portion of the body.
Figure 9:
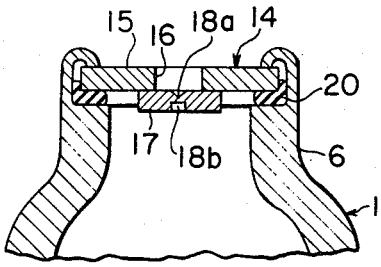
FIG. 9 is a sectional view of another sealing plate portion shown in FIG. 8, the portion being calked onto the opening portion of the body.

FIGS. 8 and 9 show sealing plate portions 14 of layer types, and through the base plate portions 15 openings 16 are provided. The openings 16 are, in small cartridges, to be passages for piercing pins to pierce subordinate plate portions 17 hereinafter described and are used, in large cartridges, for check valves. To the base plate portions 15, the subordinate plate portions 17 which are thinner than the base plate portions 15 are so attached as to close the openings 16. The limited recesses 18 or 18*a* and 18*b* in alignment with each other, as shown in FIG. 9, are provided in the subordinate plate portions 17 under the openings 16. In both the cases, to the usual inner pressures the base plate portions 15 resist them, and when the inner pressures have abnormally risen, the subordinate plate portions 17 inflate into the openings 16 and at last in the bottoms of the recesses 18 or 18*a* cracks become appear.

The method for fixing each sealing plate portion 14 may be suitably selected. FIG. 8 shows a screwing method by means of a cap nut and a ring packing 20, and FIG. 9 shows a calking method. The locations of the recesses may be suitably selected, as stated above.

Figure 10:
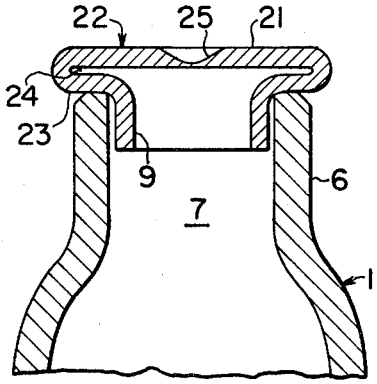
FIG. 10 is a section of a sealing plate portion which has an enlarged pressure receiving plane.
Figure 11:
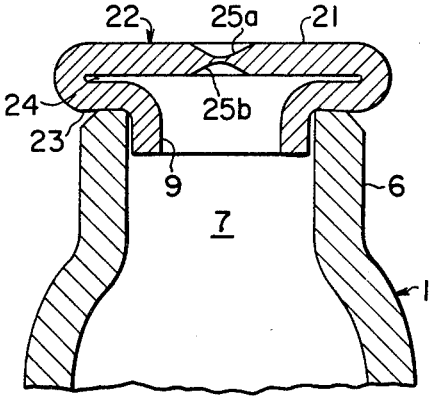
FIG. 11 is a section of another sealing plate portion shown in FIG. 10.
Figure 12:
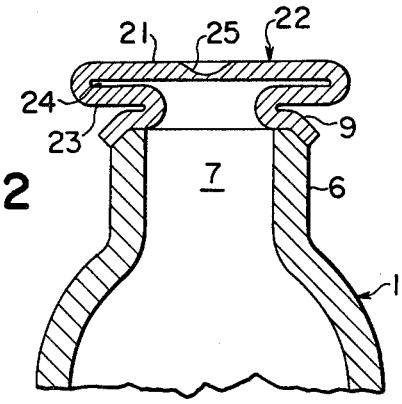
FIG. 12 is a section of further sealing plate portion shown in FIG. 10.

FIG. 10 through FIG. 12 show sealing plate portions having extended faces for receiving pressures. In each Figure, the top portion 21 of the sealing plate portion 22 overhangs out of the periphery of the opening portion 7, and the inner end of the folding back portion 23 which foldes back at the periphery thereof, is made to reach at least at the end situation of the neck portion 6. Between the underside of the top portion 21 and the upside of the folding back portion 23 is made a crearance 24. The circular leg portion 9 may be continuatively formed to the folding back portion 23. In the upside of the top portion 21 or in both the sides in alignment with each other, when the top portion 21 is comparatively thick, the limited recess 25 is or the limited recesses 25*a* and 25*b* are formed, respectively. FIG. 12 is the case where the circular leg portion 9 is closely fixed on the end face of the neck portion 6, after it has been further outwardly bent. According to a fixing method, this composition is taken. In each case, the sealing plate portion 22 receives the inner pressure in a wide area. Accordingly, though the diameter of the opening portion 7 is small, at the abnormal rising of the inner pressure, it inflates immediately outwardly, and the crack is to open through the bottom of the recess 25 or 25*a*.

I claim:

1. A cartridge assembly for containing gas, said cartridge being formed of a cylinder and a sealing plate, said plate serving to control the passage of gas out of said cylinder when excessive pressure is developed within said cartridge, including: a body, and said sealing plate positioned at the top of said body, said plate being formed with a recess disposed along a central portion thereof, and being responsive to the formation of excessive pressure within cylinder, to bow outwardly across its entire width, until the deformation of said plate under pressure is complete, said recess under pressure being rupturable within a limited area, to cause venting of the gas from within said cylinder at a relatively slow and controlled rate of emission.

2. A cartridge assembly as claimed in claim 1, wherein: the body is shell like in shape, one end of the body being provided with an open portion and in the central portion of the other end there being a spherical end portion formed of a flat thin end wall, said thin wall being provided with recess means.

3. A cartridge assembly as claimed in claim 1, wherein: the sealing plate portion at its portion facing the opening portion of the body is formed more thinly than a general portion of the body, and in said thinly formed portion there being provided a limited recessed.

* * * * *

REEXAMINATION CERTIFICATE (131st)

United States Patent [19] [11] B1 4,219,126

Oana [45] Certificate Issued Nov. 8, 1983

[54] SAFE CARTRIDGE FOR GAS

[76] Inventor: Katsuo Oana, 17-6, 4 chome, Sugano, Ichikawa-shi, Chiba-ken, Japan

Reexamination Request:
No. 90/000,190, Apr. 14, 1982

Reexamination Certificate for:

| | |
|---|---|
| Patent No.: | **4,219,126** |
| Issued: | **Aug. 26, 1980** |
| Appl. No.: | **25,061** |
| Filed: | **Mar. 29, 1979** |

[51] Int. Cl.[3] ..... B65D 25/00

[52] U.S. Cl. ..... 220/89 A; 220/266; 220/367

[58] Field of Search ..... 220/89 A, 266, 367, 220/89 B; 137/68 R; 138/89, 96 R

[56] References Cited

U.S. PATENT DOCUMENTS

| | | | |
|---|---|---|---|
| 2,726,002 | 6/1955 | Dalianis | 215/39 |
| 3,039,646 | 6/1962 | Merz | 220/27 |
| 3,815,534 | 6/1974 | Kneusel | 113/15 |
| 4,139,005 | 2/1979 | Dickey | 138/89 |

*Primary Examiner*—George T. Hall

[57] ABSTRACT

This invention relates to a safe cartridge for gas and intends that, when the cartridge has been overheated and the inner pressure has abnormally risen, let an invisible crack open in a suitable area of the cartridge to escape the inner gas gradually to reduce the inner pressure, without gushing out a large quantity of the gas in a moment, as in usual rupture discs, to prevent the flying of the cartridge by the force of reaction.

REEXAMINATION CERTIFICATE ISSUED UNDER 35 U.S.C. 307.

SAFE CARTRIDGE FOR GAS

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1 lines 5–17:

In the invention, by providing a limited *mortar like shape* recess or recesses in a thinner portion than the body of a cartridge, for example, a thin portion formed in a certain portion of the body or of a sealing plate which is fixed in respect of an opening portion of the body by welding, calking or otherwise using a cap nut and seals the opening, when the inner pressure has abnormally risen, let stresses concentrate in the thinned portion to outwardly inflate the portion. Through this inflation of the portion, a tension and a shear act on the bottom of the recess and at last [an invisible] *a* crack appears through the bottom, *said crack being restrained of its development by an increment of thickness within an invisible area* through which the inner gas is made to leak out gradually.

AS A RESULT OF REEXAMINATION, IT HAS BEEN DETERMINED THAT:

Claims 1–3 are determined to be patentable as amended:

New claims 4–6 are added and determined to be patentable.

1. A cartridge assembly for containing gas, said cartridge being formed of a cylinder and a sealing plate, said plate serving to control the passage of gas out of said cylinder when excessive pressure is developed within said cartridge, including: a body, and said sealing plate positioned [at] *to* the top of said body, said plate being formed with a recess *creating a thinned portion* disposed along a central portion thereof, and being responsive to the formation of excessive pressure within *said* cylinder[,] to bow outwardly across its entire width, until the deformation of said plate under pressure is complete *with tension and sheer stresses acting on the bottom of said recess*, said recess under pressure being [rupturable within a limited area] *formed in shape like a mortar in which the thickness of said plate increases from its center portion to the circumference, so as to rupture within a limited area by the formation of hairline-like cracks and without the softening or melting of said thin portion of said plate*, to cause *the gradual* venting of the gas from within said [cylinder] *chamber* at a relatively slow and *safely* controlled rate of emission *and without any blow-out of said plate or explosion of said cartridge.*

2. A cartridge assembly as claimed in claim 1, wherein [: the] *said* body is [shell like] *shell-like* in shape [,] *and capable of withstanding a pressure from about 70 Kg/cm² to a pressure of the order and magnitude of at least about 400 Kg/cm²; and wherein* one end of the body being provided with an open portion and in the central portion of the other end there being a spherical end portion formed of a flat, thin end wall, said thin wall being provided with a recess means.

3. A cartridge assembly as claimed in claim 1, wherein [: the] *said* sealing plate portion at its portion facing the opening portion of the body is formed more thinly than a general portion of the body, and in said thinly formed portion there being provided *at least one form of* a limited [recessed] recess.

*4. A cartridge assembly as claimed in claim 2, wherein said recess means is the shape of a centralized dimple.*

*5. A cartridge assembly as claimed in claim 1, wherein said recess is provided in the outer face of said plate and appears like a dimple.*

*6. A cartridge assembly as claimed in claim 1, wherein said recess is provided in the inner face of said plate and appears like a dimple.*

* * * * *